US009543695B2

(12) United States Patent
Møgedal et al.

(10) Patent No.: US 9,543,695 B2
(45) Date of Patent: Jan. 10, 2017

(54) PRE-TENSIONED CONNECTOR

(75) Inventors: Knut Møgedal, Asker (NO); Steingrim Thommesen, Oslo (NO)

(73) Assignee: Aker Subsea AS, Lysaker (NO)

( * ) Notice: Subject to any disclaimer, the term of this patent is extended or adjusted under 35 U.S.C. 154(b) by 596 days.

(21) Appl. No.: 14/003,973

(22) PCT Filed: Mar. 9, 2012

(86) PCT No.: PCT/EP2012/001045

§ 371 (c)(1),
(2), (4) Date: Oct. 24, 2013

(87) PCT Pub. No.: WO2012/123087

PCT Pub. Date: Sep. 20, 2012

(65) Prior Publication Data

US 2014/0170884 A1 Jun. 19, 2014

(30) Foreign Application Priority Data

Mar. 11, 2011 (NO) ..... 20110380

(51) Int. Cl.
*E21B 33/038* (2006.01)
*H01R 13/621* (2006.01)
*H01R 43/26* (2006.01)

(52) U.S. Cl.
CPC ..... *H01R 13/6215* (2013.01); *E21B 33/038* (2013.01); *H01R 43/26* (2013.01); *Y10T 29/49004* (2015.01)

(58) Field of Classification Search
CPC ..... F16L 37/0842; F16L 37/12; F16L 37/122; F16L 37/138

(Continued)

(56) References Cited

U.S. PATENT DOCUMENTS 2,259,137 A * 10/1941 Iftiger, Sr. ..... F16L 37/1215 285/35
3,096,999 A * 7/1963 Ahlstone ..... E21B 33/038 285/322

(Continued)

FOREIGN PATENT DOCUMENTS

WO WO-03002845 A1 1/2003
WO WO-2010069863 A1 6/2010
WO WO-2010081621 A2 7/2010

OTHER PUBLICATIONS

Bellingacci, F., "International Search Report" for PCT/EP2012/001045, as mailed Jul. 16, 2013, 5 pages.

*Primary Examiner* — David E Bochna
(74) *Attorney, Agent, or Firm* — Winstead PC

(57) ABSTRACT

Connector (100) with locking components (107) about a peripheral section of the connector. The locking components extend in an axial direction engage with the connector (100) at a first end and engage with a connecting part (201) at an opposite locking end with a locking profile (109). A radial locking movement of the locking end is provided by an axial movement of an actuation sleeve (113). The locking components (107) are arranged to pivot in a substantially radial direction, about their section of engagement with the connector (100), into and out of a locking position. The connector (100) comprises guiding plates (111) between the locking components (107) in the area of their locking ends. The guiding plates exhibit protective faces (111*a*) that extend further radially inwards than the locking profile (109) of the locking components (107) when the latter are in the outwardly pivoted position.

8 Claims, 11 Drawing Sheets

(58) Field of Classification Search
USPC ..... 285/322, 920
See application file for complete search history.

(56) References Cited

U.S. PATENT DOCUMENTS

| | | | | | |
|---|---|---|---|---|---|
| 3,321,217 | A | | 5/1967 | Ahlstone | |
| 4,516,795 | A | | 5/1985 | Baugh | |
| 4,693,497 | A | * | 9/1987 | Pettus | E21B 33/038 285/920 |
| 4,708,376 | A | * | 11/1987 | Jennings | E21B 33/038 285/920 |
| 4,902,044 | A | * | 2/1990 | Williams | E21B 33/038 285/920 |
| 6,851,728 | B2 | * | 2/2005 | Minami | F16L 19/086 285/323 |
| 7,140,645 | B2 | * | 11/2006 | Cronley | F16L 37/1215 285/322 |
| 8,904,621 | B2 | * | 12/2014 | Patterson | F16L 25/06 285/322 |
| 9,009,927 | B2 | * | 4/2015 | Rigollet | F16L 33/03 285/322 |
| 2004/0113426 | A1 | * | 6/2004 | Milberger | E21B 33/038 285/330 |
| 2005/0001427 | A1 | * | 1/2005 | Liew | F16L 37/002 285/322 |
| 2005/0146137 | A1 | * | 7/2005 | Davidson | E21B 33/038 285/322 |
| 2013/0175055 | A1 | * | 7/2013 | Hart | E21B 33/03 166/387 |
| 2014/0262307 | A1 | * | 9/2014 | Caldwell | E21B 33/038 166/340 |
| 2015/0069755 | A1 | * | 3/2015 | Bull | E21B 33/038 285/406 |

* cited by examiner

PRE-TENSIONED CONNECTOR

The present invention relates to a connection assembly adapted for connection of two circular or pipe-shaped elements, which connection exhibits a predetermined pre-tension. In particular the connection assembly may be an emergency disconnection package (EDP) between components in association with a subsea well, such as between a lower part of a riser and the upper part of a lower riser package (LRP).

BACKGROUND

For connections being exposed to large and continuous variations of force, it is known to provide the force-adsorbing components with a pre-tension in order to prevent play and resulting fatigue during such force variations. In the art there is a plurality of solutions for obtaining a predetermined pre-tension. One way is to simply tighten a nut on an elongated bolt with a certain torque, resulting in the bolt being tensioned with a certain force.

Other solutions involve moving inclined faces against each other along a predetermined distance, thereby stretching force-adsorbing components to which one of the faces is functionally connected a predetermined distance. One such solution is described in international patent application publication WO 2010069863. Here, the inclined faces are first made to abut each other, and then they are moved, sliding against each other along a predetermined distance. This results in a predetermined pre-tension in a connection sleeve carrying one of the inclined surfaces. A similar solution is described in WO03002845.

Furthermore, it is known to connect to tubular members, either within bores or externally, by means of locking elements that are moved in a radial direction by actuation of an actuation member. International patent application publication WO 2010081621 describes a connector assembly which is suited to connect to the external or internal locking profiles of a tubular element. This solution exhibits a plurality of locking elements which are moved radially into and out of a locking engagement by means of an activation sleeve engaging the locking elements.

Patent application publication US 20050146137 describes a connector with pivoting fingers that engages the flanges of two oppositely pipe ends. By appropriate selection of the radial size of a pre-tension ring (22) the operator may choose a predetermined amount of pretension in the fingers.

Another patent application publication, US 2005001427, describes another connector assembly where a plurality of collet fingers that engage a profile at each end of a pipe section. The collet fingers are forced into engagement with a threaded outer sleeve that is slid over the fingers and with an inclined face forces the collets into said profiles.

Publication U.S. Pat. No. 4,708,376 describes a hydraulic collet type connector adapted to lock onto a wellhead. A plurality of pivoting collet segments are arranged about the periphery of an upper body and adapted to connect to a locking groove in the wellhead.

THE INVENTION

The present invention provides a connector assembly that exhibits radially movable connecting members, while at the same time fulfilling the object of having a predetermined pre-tension in the force-adsorbing components.

According to a first aspect of the present invention, there is provided a connector comprising a plurality of locking components distributed about a peripheral section of the connector at a connecting side of the connector. The locking components extend in a substantially axial direction and are adapted to engage with the connector at a first end and to engage with a connecting part at an opposite locking end. The said opposite locking end is provided with a locking profile. A substantially radial locking movement of the locking end is provided by an axial movement of an actuation sleeve when sliding against an actuation face of the locking component. The locking components are arranged to pivot in a substantially radial direction, about their section of engagement with the connector, into and out of a locking position. According to the invention, the connector further comprises guiding plates arranged between the locking components in the area of their locking ends, which guiding plates exhibit protective faces that extend further radially inwards than the locking profile of the locking components when the latter are in the outwardly pivoted position.

Advantageously, the locking components can comprise an unlocking shoulder extending radially outwards in the area of the first end, wherein the unlocking shoulder is adapted to be moved upwards when pivoting the locking components out of the locking position. In this way, the same actuation element can be used for locking and unlocking the locking components, as will be described later with reference to the figures.

In one embodiment, the locking profile of the locking components preferably exhibits one or more inclined faces that face partially radially inwards and partially axially towards the connector. Furthermore, the first end of the locking components exhibits an inclined adjusting face which abuts and is adapted to slide on an oppositely facing inclined face of the connector. The inclined face of the connector faces partially axially away from the locking end of the locking components and partially radially outwards. Moreover, the connector further comprises means adapted to move the inclined adjusting face radially inwards on said inclined face. In this way the locking components are moved axially, and the inclined adjusting face is retained in an end position. I.e. it is prevented from moving the opposite way on the inclined face. Thus, the end position refers to the position at which the locking component will not move further radially inwards because it is prevented from moving further axially away from its locking profile. The means will not retain the locking component from moving further inwards, just from moving back outwards. When the locking components are moved axially away from the element to which they lock, they will eventually be prevented from further movement in that direction when engaging this element.

Preferably the said means comprises a pre-tension ring which is arranged on the connector by means of threads. Thus, it moves axially by rotation on the connector and is adapted to move the inclined adjusting face radially inwards by sliding engagement with an inclined sliding face of the locking components during said rotation.

According to a second aspect of the present invention there is provided an assembly comprising a connector according to one of the embodiments comprising means adapted to move the inclined adjusting face radially inwards on the inclined face, such as an adjustment ring, as well as a calibration part. The calibration part exhibits a landing face and calibration part locking profile. The calibration part locking profile is adapted to be engaged by the locking profile of the locking components. Furthermore, according to the second aspect of the invention, the axial distance between the landing face of the calibration part and its locking profile is a predetermined distance less than the corresponding distance of a connecting part to which the connector is adapted to connect. With such an assembly, one can adjust the position of the locking components on the connector by using the calibration part in such a way that one will obtain a predetermined pre-tension in the locking components when connecting the connector to the connecting part to which the connector finally is to be connected. This will be explained further below with reference to the drawings.

According to a third aspect of the present invention, there is provided a method of establishing a predetermined pre-tension in the locking components of a connector when landed on a landing face of a connecting part. The locking components are adapted to extend in a substantially axial direction from said connector towards the connecting part and to engage with a locking profile of the connecting part when the connector is landed on said landing face. The locking profile of the connecting part comprises an inclined abutting face which faces partially radially outwards from the connecting part and partially axially away from the connector and the locking components comprises a locking profile with substantially oppositely facing abutting faces. The axial distance between said inclined abutting face and a landing surface of the connecting part, onto which the connector is adapted to land, equals a first distance. Furthermore, the axial distance between a corresponding inclined abutting face and landing surface of a calibration part equals a calibration distance which is less than the first distance. According to the invention, the method comprises the following steps:

a) landing the connector onto the landing face of the calibration part;
b) moving the locking profiles of the locking components a predetermined radial actuation distance into engagement with the calibration part locking profiles;
c) by means of a pre-tension adjustment means, pulling the locking components axially towards the connector until the inclined abutting face of the calibration part locking profile abuts the facing abutting face of the locking profile of the locking components, thereby limiting the movement of the locking components in the axial direction towards the calibration part;
d) releasing the engagement to the calibration part; and then
e) landing the connector onto the landing face of the connecting part and moving the locking profiles of the locking components the said predetermined radial actuation distance into engagement with the locking profile of the connecting part.

In a preferred embodiment of the third aspect of the invention, the pre-tension adjustment means is a pre-tension ring attached to the connector by means of threads. Furthermore, according to this embodiment step c) comprises rotating the pre-tension ring, thereby moving it axially in the direction of the calibration part and thereby sliding it against an inclined face of the locking components and thus pulling the locking components axially towards the connector, as the locking component slides radially inwards on an inclined face of the connector.

EXAMPLE OF EMBODIMENT

While the various aspects of the present invention has been described in general terms above, a more detailed and non-limiting example of an embodiment will be described in the following with reference to the drawings, in which FIG. 1 is a schematic view of a possible employment of the connector according to the present invention;

Figure 1:
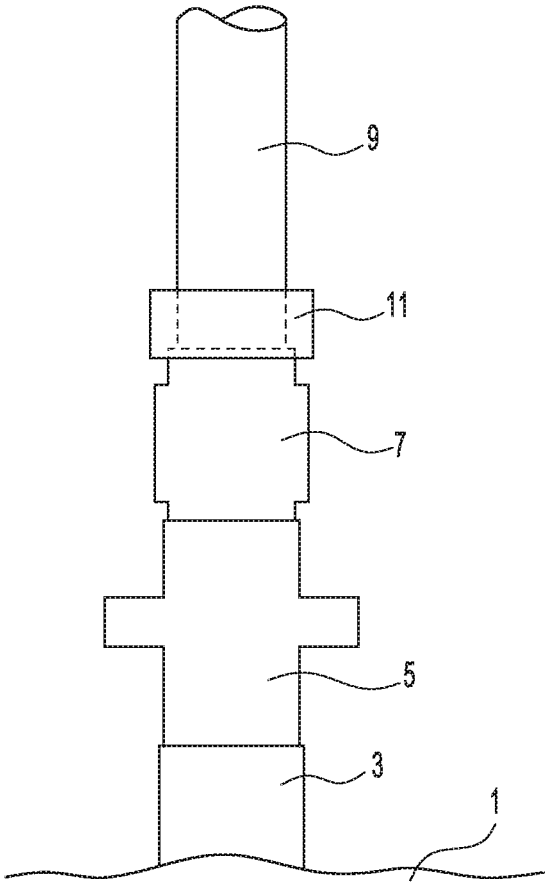

One possible application of the connector according to the present invention is a connector is in form of an emergency disconnection package (EDP) arranged to the lower end of a riser and making the connection between the riser and a lower riser package. FIG. 1 is a schematic view of such a setup. A wellhead 3 extends up from a seabed 1 and is connected to a Xmas tree 5. On top of the Xmas tree 5 is arranged a lower riser package 7 and to the lower riser package 7 there is connected a riser 9 which extends up to a surface vessel (not shown). Making the connection between the riser 9 and the lower riser package 7 (LRP) is an EDP 11 according to the present invention. The setup in FIG. 1 is only one of a plurality of possible applications of a connector according to the invention. Hence, such a connector can be used to connect a plurality of various components, in particular circular shaped components such as pipe spools, as will be apparent for the person skilled in the art.

Operation of the Connector

Figure 2:
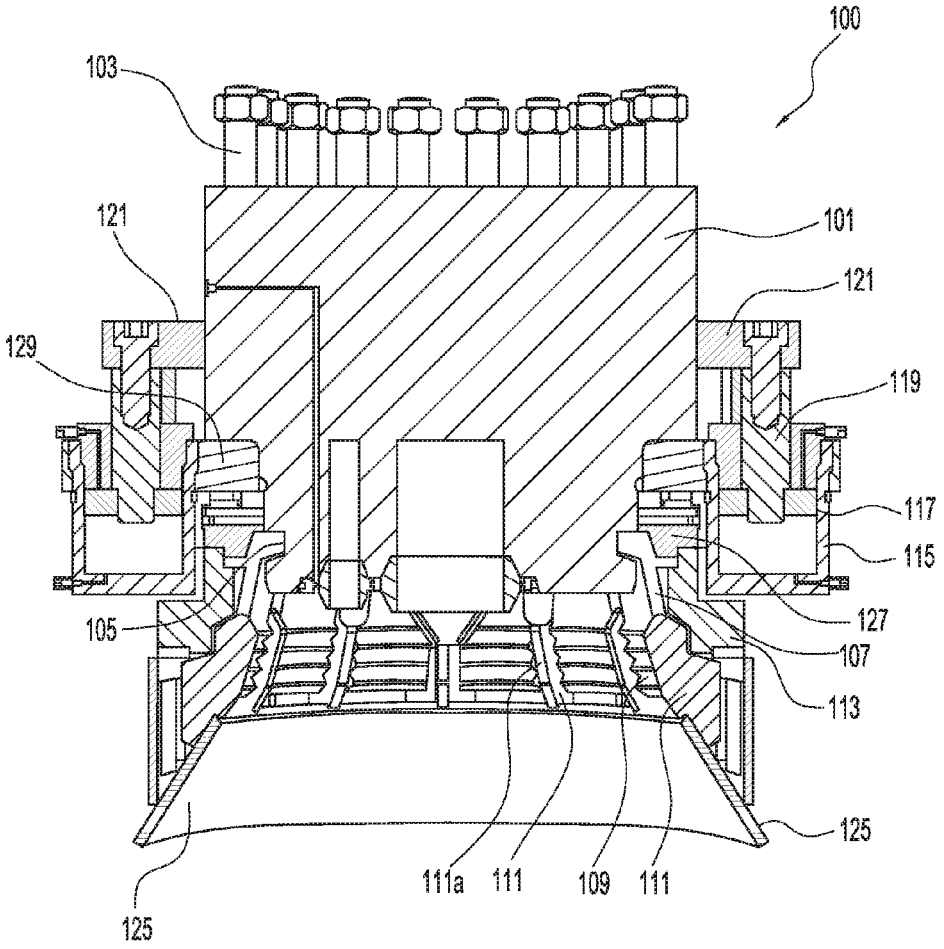
FIG. 2 is a cross section view of the an embodiment of the connector according to the invention.

FIG. 2 shows a connector 100 according to the present invention. The connector 100 could for instance be used as the EDP 11 shown with reference to FIG. 1. Regardless of its particular employment, the function and components of the connector 100 will be described in the following.

The connector 100 has a main body 101 which in its upper end is arranged to be connected to a lower end of a riser section (not shown) or other equipment by means of a plurality of bolts 103. At the lower portion of the main body 101 a groove 105 extends about its periphery. The groove 105 is adapted to receive the upper parts of a plurality of collets 107. In this embodiment there are arranged 12 collets 107 about the lower circumference of the main body 101. The collets 107 exhibit a locking profile 109 at their lower section. The locking profiles 109 face radially inwards and are adapted to engage with a facing profile of a hub to which the connector 100 will connect. This will be described further below.

Between the collets 107 are guiding plates 111 which contribute to retain the collets 107 in place and guide them when they are moved radially. As will appear from the description further below, the collets 107 are arranged to pivot about their section of engagement with the groove 105 in the main body 101. In FIG. 2, the collets 107 are shown in a position in which their lower part is pivoted radially outwards.

In order to pivot the collets 107 radially inwards and outwards there is arranged an actuating sleeve 113. The actuating sleeve 113 is adapted to be moved upwards and downwards, thereby pivoting the collets 107, in particular the locking profile 109 of the collets 107, outwards and inwards.

Figure 3:
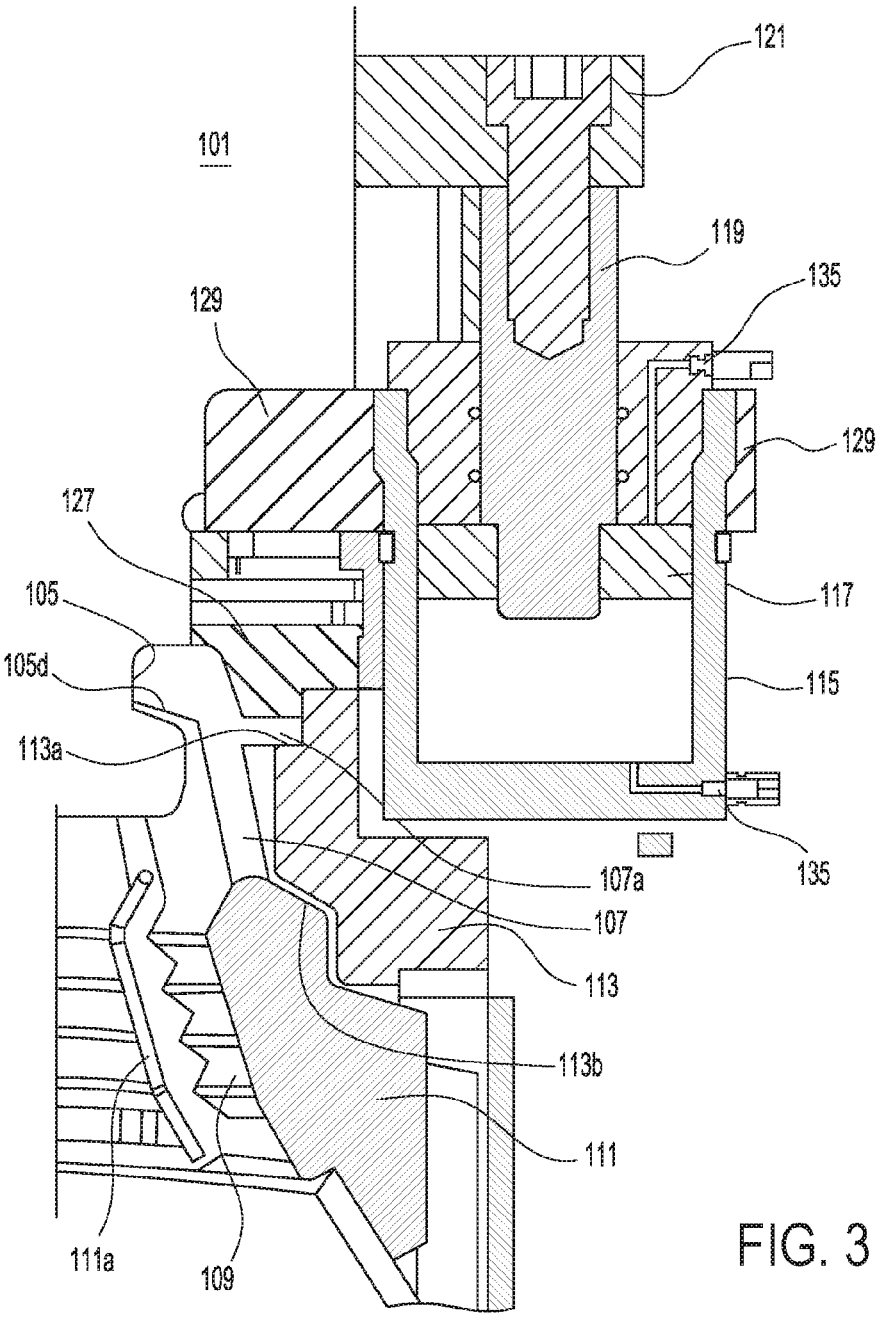
FIG. 3 is an enlarged cross section view of a part of the connector.

In FIG. 2 and FIG. 3, the actuating sleeve 113 is shown in an upper position. In this position, an unlocking shoulder 113*a* (FIG. 3) engages an unlocking shoulder 107*a* of the collet 107, thereby providing an outwardly pivoting movement of the collet 107, about its engagement with the groove 105 in the main body 101.

Figure 4:
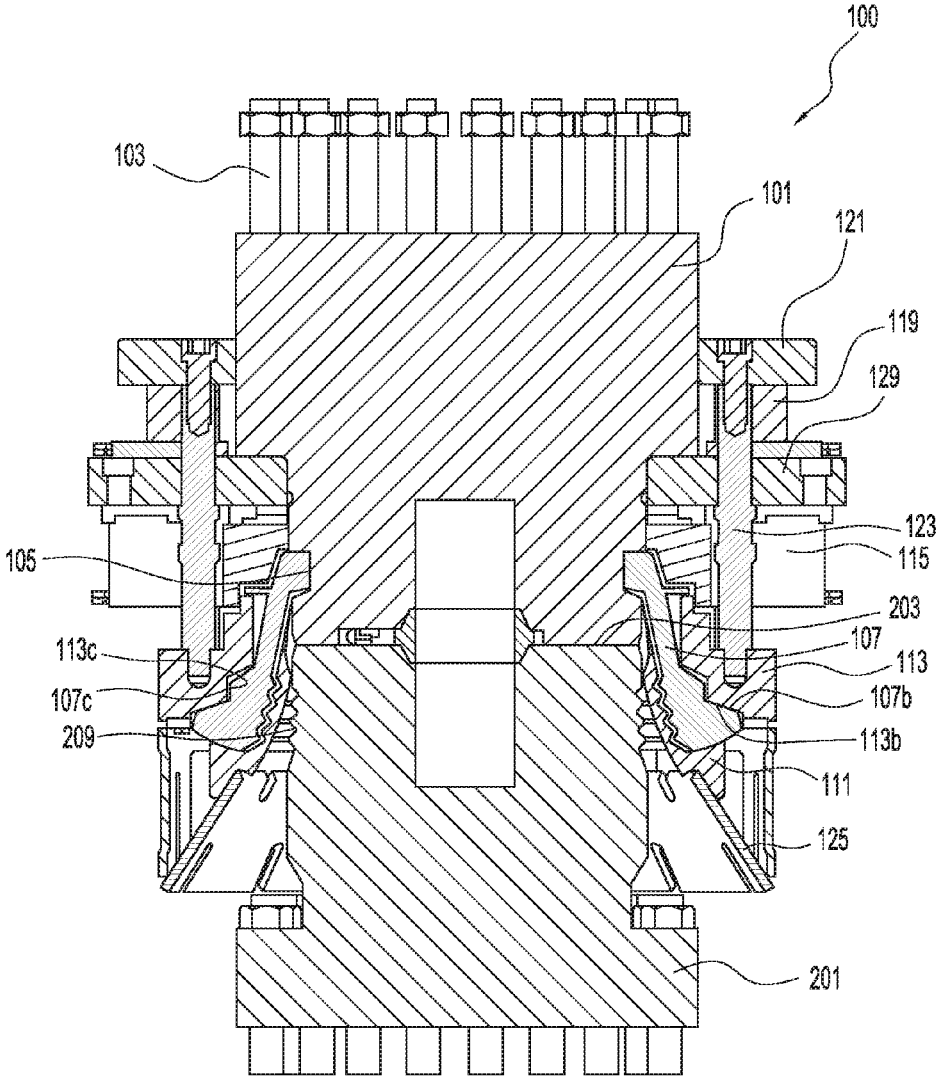
FIG. 4 is a cross section view of the connector landed onto a hub.

FIG. 4 shows a cross section view of the connector 100, along another plane than shown in FIG. 2 and FIG. 3. In this drawing the connector 100 is shown landed onto a landing face 203 of a connecting part, however not yet connected to it. Here the connecting part is in form of a hub 201. Here one can see how the actuating sleeve 113 has pivoted out the collets 107. One can also see the entire cross section profile of the collets 107, without the guiding plates 111 in front. The hub 201 comprises locking profiles 209 extending about its upper periphery, adapted to engage with the locking profiles 109 of the collets 107.

Figure 8:
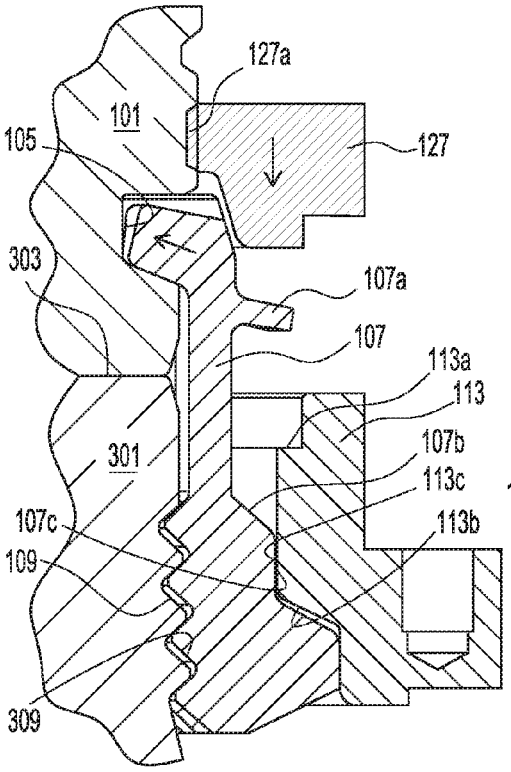
FIG. 8 is an enlarged cross section view of a part of the connector landed onto a calibration hub.

The actuation sleeve 113 comprises an inclined actuation face 113*b* which is adapted to slide against a facing and inclined collet actuation face 107*b* of the collet 107. These inclined faces 113*b*, 107*b* provide the inward pivoting movement of the collet 107 when the actuation sleeve 113 is moved downwards. The collet 107 and the actuation sleeve 113 also have vertical faces 107*c*, 113*c* that face each other when in a locking position. These faces are indicated in FIG. 8.

Figure 5:
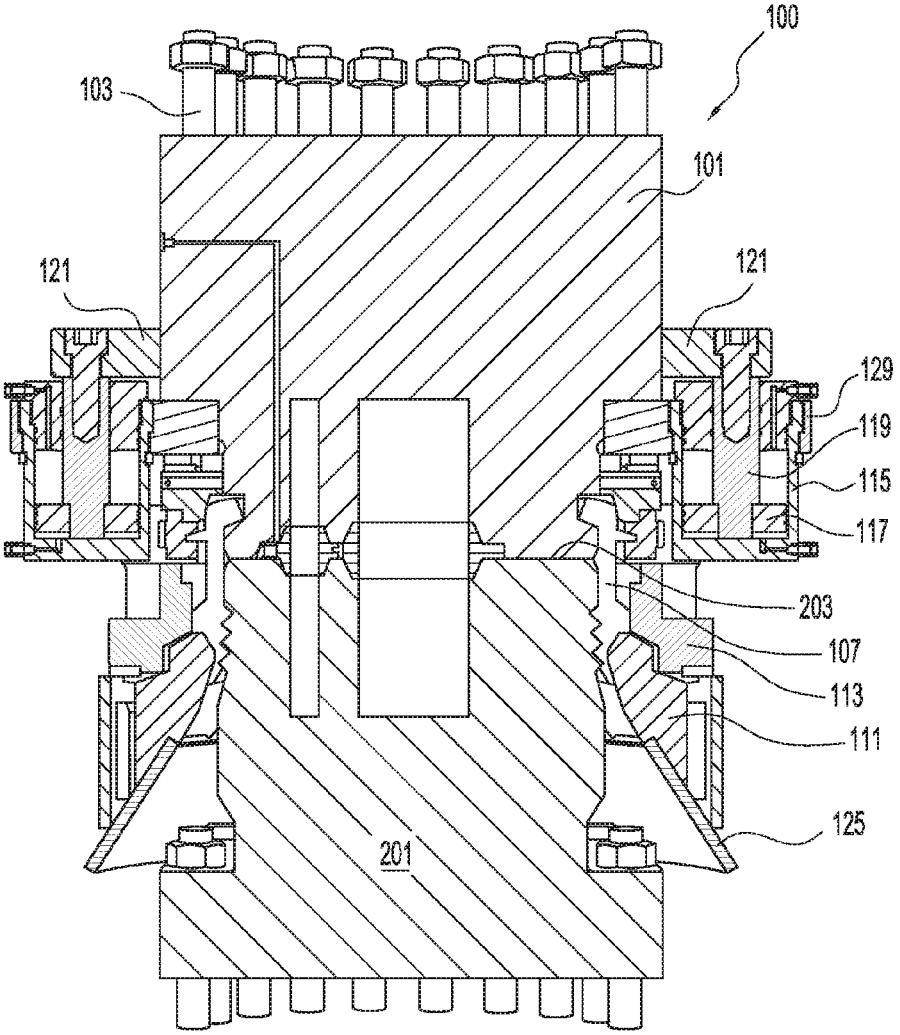
FIG. 5 is a cross section view of the connector connected to the hub.

FIG. 5 shows a cross section view of the connector 100 landed on the landing face 203 and connected to the hub 201. The collets 107 have been pivoted inwards so that their locking profiles 109 are in engagement with the hub locking profiles 209.

The process of moving the actuation sleeve 113 and thus the collets 107 will now be described with reference to FIGS. 2-6. About the circumference of the main body 101 of the connector 100 is arranged a plurality of hydraulic cylinders 115 having a piston 117 and a piston rod 119 extending out of them. The cylinders 115 are fixed with respect to the main body 101, while the piston rods 119 move up and down by actuation of the piston 117. To the upper end of the piston rods 119 there is attached an actuation ring 121 which moves along with the piston rods 119. Also connected to the actuation ring 121 is a plurality of actuation rods 123. The actuation rods 123 extend downwards from the actuation ring 121 and connect to the actuation sleeve 113. This is shown in FIG. 4. Thus, the actuation sleeve 113 is moved in the axial direction by actuation of the hydraulic pistons.

Also attached to (directly or indirectly) and moved with the actuation rods 123 is a funnel 125 at the lower part of the connector 100. The funnel 125 assists in guiding the connector 100 onto the part to which it shall be connected, such as the hub 201 shown in FIG. 4, FIG. 5 and FIG. 6. Furthermore, the guiding plates 111 are also moved axially along with the actuation sleeve 113 and the funnel 125.

Figure 6:
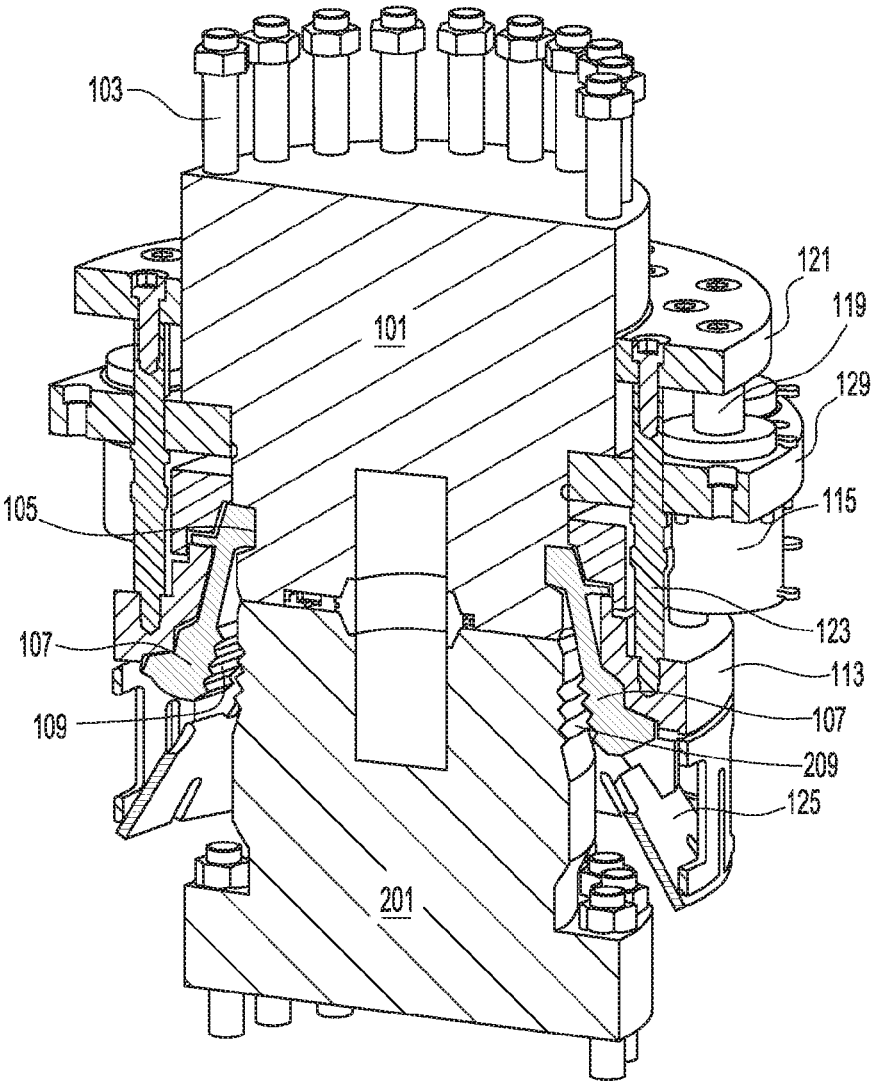
FIG. 6 is a perspective cross section view of the connector and the hub.

FIG. 6 is a section cross section perspective view of parts of the connector 100 in the process of landing onto a hub 201. In the shown situation, the main body 101 of the connector 100 has landed onto the hub 201. However, the collets 107 have not yet been rotated into engagement with the hub locking profiles 209.

About the circumference of the main body 101 there are arranged 12 cylinders 115. Since the connector 100 in the described embodiment will be part of an emergency disconnection package (EDP), the 12 cylinders are divided into a primary and secondary system. Preferably, six cylinders 115 are included in the primary system and six are included in the secondary system. During normal use of the connector 100, only the primary system will be used for actuating the collets. However, in an emergency situation requiring a disconnection, both the primary and the secondary system may be actuated in order to ensure a disconnection.

It is again referred to FIG. 5 which shows the collets 107 and their locking profiles 109 in engagement with the hub locking profiles 209. In this position, the cylinders 115 have been moved downwards by means of pressurizing the chamber above the piston 117 in the six cylinders 115 of the primary system. It is worth noting that in this locked position the components adsorbing the axial forces of the connection are the collets 107. The forces exerted onto the actuation sleeve 113 are possible radial forces from the collets 107.

Figure 7:
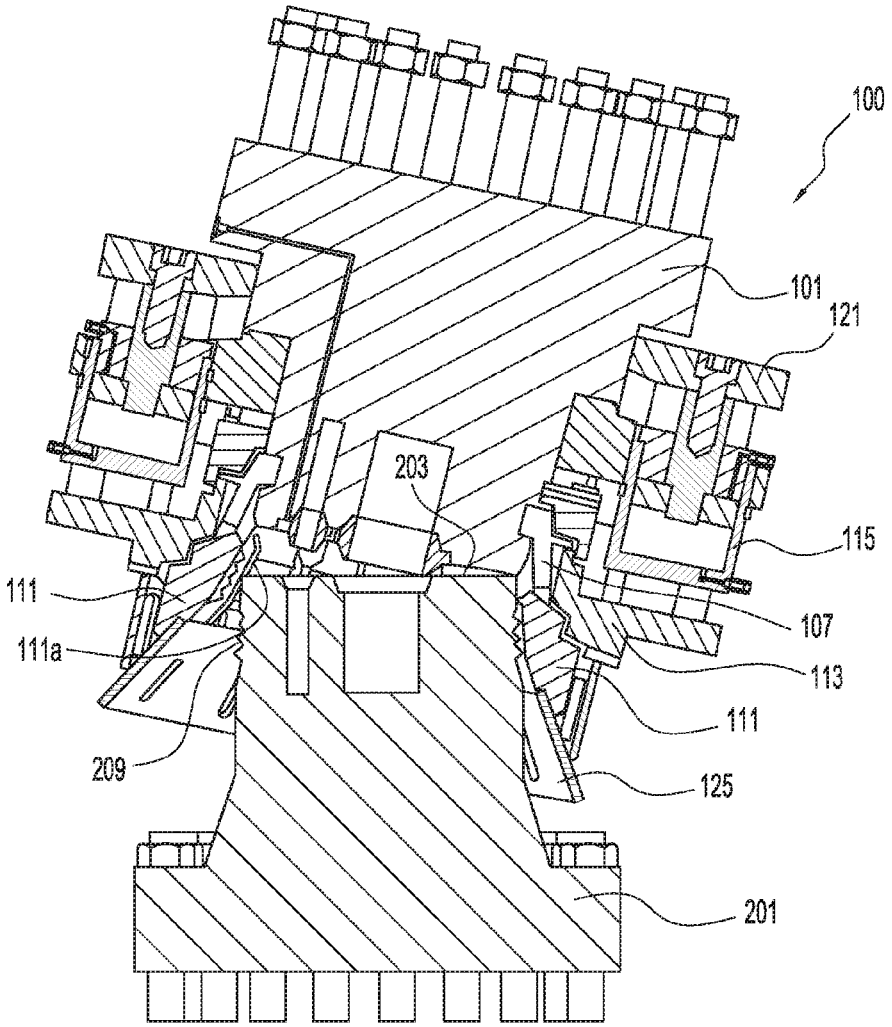
FIG. 7 is a perspective view of the connector, having an inclination with respect to the hub.

FIG. 7 illustrates the connector 100 during a disconnection process (or a connection process). The collets 107 are in the outwardly pivoted, disconnected position. In this position, the collets 107 will be retracted with respect to the guiding plates 111, and in particular with respect to protective faces 111*a* of the guiding plates 111. That is, the protective faces 111*a* extend further radially inwards than the collet locking profiles 109. In this way, the locking profiles 109 of the collets 107 are protected from damaging impacts against the hub 201 or any other corresponding part. FIG. 2 and FIG. 4 show particularly well how the collets 107 are pivoted radially outwards beyond the position of the guiding plates 111.

Still referring to FIG. 7, the connector 100 is shown with only a portion landed on the hub 201 and with an inclination of about 10 degrees with respect to the hub 201. In this inclined position, the guiding plate 111 shown on the right hand side in FIG. 7 has a face substantially parallel with the axial extension of the hub 201. When pulling up the connector 100, this guiding plate 111 (along with the adjacent ones) will possibly slide against the hub locking profiles 209 without damaging them, or the guiding plates arranged diametrically opposite to it will slide against the upper left edge portion of the hub 201. In both cases the hub locking profiles 209 as well as the locking profiles 109 of the collets 107 are protected from damaging impacts by means of the guiding plates 111.

The feature of a possible inclination between the connector 100 and the part to which it is connected, such as the lower riser package 7 (LRP) of FIG. 1, has substantial advantage during an emergency disconnection. If, for instance, the vessel (not shown) to which the connector 100 is connected through a riser drifts off or instantaneously needs to leave its position, it may not have time to pull up the riser. The EDP or connector 100 is then suited to handle a certain angle between the connector 100 and the part to which it is connected, without causing damage to either part. For instance, the collets 107 can be pivoted out and the connector 100 may be drawn off the remaining part when the vessel has moved a substantial distance away from its original position.

Pre-Tensioning of Collets

Having described the main operational features of the connector 100 according to the invention above, a method and associated equipment for arranging a predetermined pre-tension in the collets 107 will be described in the following. A person skilled in the art will appreciate that the collets 107 of the above described connector 100 should be arranged with a pre-tension when in the locking position, such as the position shown in FIG. 5. The pre-tensioning of the collets will contribute to a proper connection during varying loads on the connection, as it prevents play between the components during load variations.

FIG. 8 is an enlarged cross section view of a collet 107, actuating sleeve 113, the collet receiving groove 105 of the main body 101, and a pre-tension ring 127. The connector main body 101 has now landed onto the landing face 303 of a calibration hub 301. With regards to the shape and dimensions, the calibration hub 301 corresponds to the hub 201 described above, except for the axial distance between the hub locking profiles 209,309 and the landing face 203, 303, onto which the connector main body 101 lands. At the calibration hub 301 this distance is slightly smaller than the corresponding distance at the hub 201.

Figure 9:
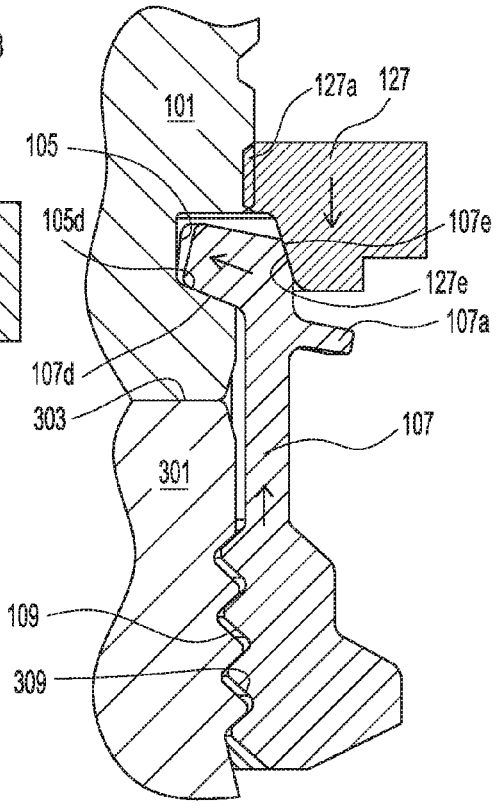
FIG. 9 is an enlarged cross section view corresponding to FIG. 8, with a locking collet in an adjusted position.

In order to calibrate or set the amount of pre-tension to be arranged in the collets 107 when the connector 100 connects to the hub 201, the connector 100 is first landed onto the calibration hub 301 indicated in FIG. 8. Then the actuating sleeve 113 is moved down so that the collets 107 engage the facing locking profiles 309 of the calibration hub 301. After this step, a pre-tension adjustment means, in form of a pre-tension adjustment ring 127, which is arranged on the circumference of the main body 101 by means of threads 127*a*, is rotated so that it moves downwards on the main body 101. When the pre-tension ring 127 moves down, it slides with its sliding face 127*e* against a facing sliding face 107*e* of the collet 107, thereby moving the upper part of the collet 107 radially inwards. Furthermore, the inward movement of the upper part of the collet 107 results in that the collet is pulled upwards due to its sliding contact with an inclined face 105*d* of the collet receiving groove 105 of the main body 101. The collet 107 has an inclined adjusting face 107*d* which is in sliding contact with the said inclined face 105*d* of the groove 105. The pre-tension ring 127 is rotated and moved downwards until the collet 107 cannot be pulled further up due its engagement with the locking profiles 309 of the calibration hub 301. This situation is shown in FIG. 9. In FIG. 9 the arrows indicate the movement of the collet 107 and the pre-tension ring 127, respectively.

Figure 10:
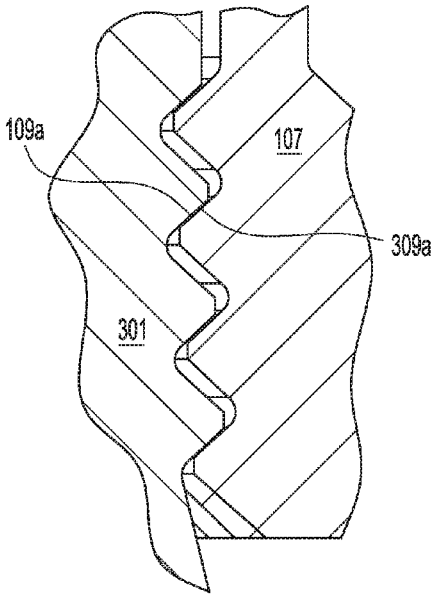
FIG. 10 is a schematic principle view of an engagement of a locking collet with a calibration hub.

FIG. 10 is an enlarged schematic view of the situation shown in FIG. 9. The calibration hub locking profiles 309 of the calibration hub 301 are in engagement with the locking profiles 109 of the collet 107. Also indicated are downwardly facing and inclined abutting faces 309*a* of the calibration hub locking profiles 309, which abut upwardly facing abutting faces 109*a* of the collet locking profiles 109. This abutment is what halts the upward movement of the collet 107 when rotating the pre-tension ring 127 to move it downwards and to pull the collet 107 upwards.

Figure 11:
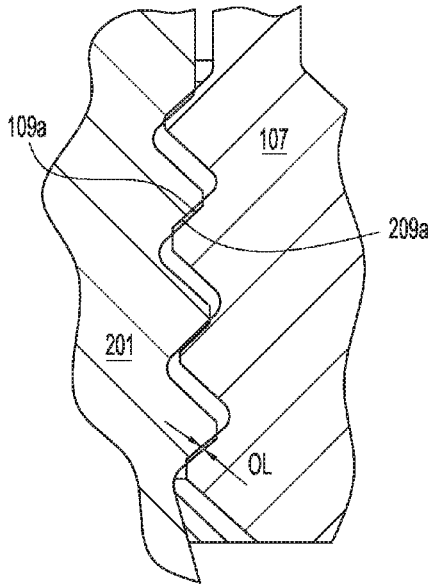
FIG. 11 is a schematic principle view corresponding to FIG. 10, however with the hub to which the connector shall connect.

FIG. 11 is a view corresponding to the view of FIG. 10. However, FIG. 11 shows the collet 107 in engagement with the hub 201, whereas FIG. 10 shows the calibration hub 301. After having calibrated or adjusted the axial position of the collets 107 on the calibration hub 301, as shown in FIGS. 8 to 10, the connector 100 is landed onto the hub 201. In FIG. 11, the abutting faces 109*a*, 209*a* of the collet locking profile 109 and the hub locking profile 209, respectively, are shown overlapping each other with an overlap OL. This will of course not be possible in a real scenario. The purpose of this drawn overlap OL is to show that when landed onto the hub 201, the collets 107 does not have sufficient axial extension to be forced into the hub locking profiles 209 without being tensioned a certain amount. That is, when the locking profiles 109 of the collets 107 are forced into the facing locking profiles 209 of the hub 201, the inclined faces 109*a* and 209*a* will slide against each other and the collets 107 will be pulled a predetermined distance in the axial direction, thereby being arranged with a predetermined pre-tension.

Thus, with the above described solution for pre-tensioning the collets 107, the amount of pre-tension is determined by the difference in axial distance between the locking profiles 209, 309 and the upper landing face of the hub 201 and the calibration hub 301, respectively. As will be appreciated by the person skilled in the art, the dimensions of the collets 107 must be within a certain tolerance range so that any dimension differences will not affect the amount of pre-tension beyond an allowable amount.

Arrangement of Hydraulic Cylinders

In the following the hydraulic cylinders 115 and their attachment to the main body 101 will be described in further detail, particularly with reference to FIG. 12, FIG. 13, and FIG. 14.

Figure 12:
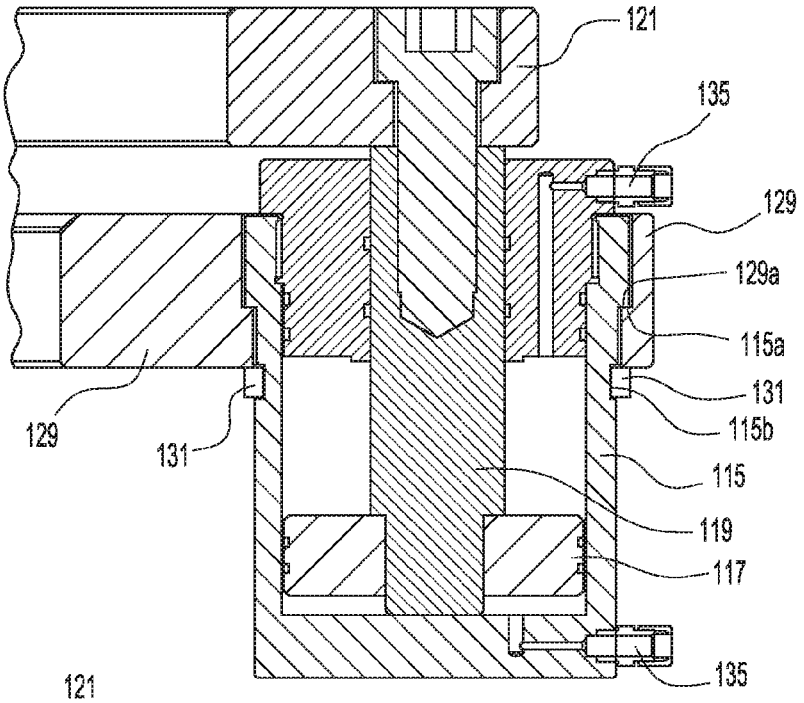
FIG. 12 is an enlarged cross section view of a hydraulic cylinder which is part of the connector.

FIG. 12 is an enlarged cross section view of one of the hydraulic cylinders 115 of the connector 100 described above. Arranged within the cylinder 115 is the piston 117, to which is arranged a piston rod 119 that extends vertically out of the cylinder and is attached to the actuator ring 121, as described above. The cylinder 115, along with the other cylinders 115 of the connector, is attached to the main body 101 through a flange 129 that encircles the main body 101.

To retain the cylinder 115 from downward movement with respect to the flange 129, a collar 115*a* of the cylinder body lands on a shoulder 129*a* of the flange 129. Furthermore, to retain the cylinder 115 from upward movement, there is arranged a ring 131, preferably a split ring, which is arranged in a peripheral recess 115*b* extending around the cylinder 115. When the cylinder 115 is forced upwards with respect to the main body 101, the ring 131 transmits forces from the recess 115*b* to the attachment flange 129.

Figure 13:
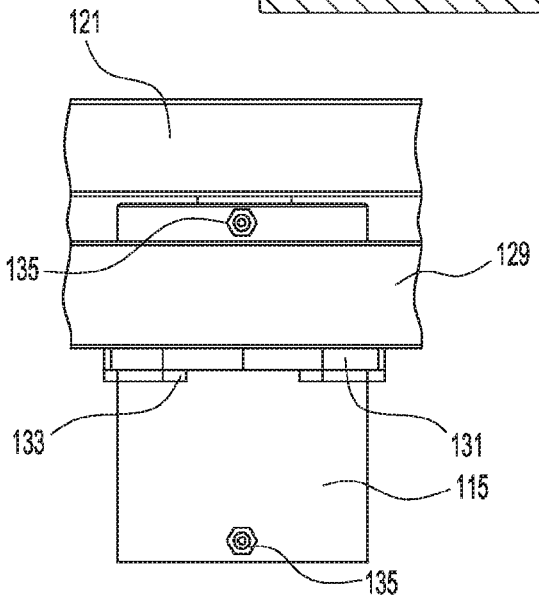
FIG. 13 is a front view of the hydraulic cylinder shown in FIG. 12.

FIG. 13 is an enlarged front view of the cylinder 115 and a part of the attachment flange 129 and the actuator ring 121. The ring 131 is attached to the attachment flange 129 by means of a plurality of bolts 133, as also shown in the enlarged perspective view of FIG. 14. The bolts 133 are only arranged in order to retain the ring 133 in place, and will not adsorb forces exerted by the hydraulic actuation of the cylinder 115. Such forces are transmitted from the cylinder 115 to the attachment flange 129 through the ring 131. Contrary to solutions where bolts are arranged to transmit such forces, this solution will occupy much less space due to the smaller dimensions of the bolts 133.

Figure 14:
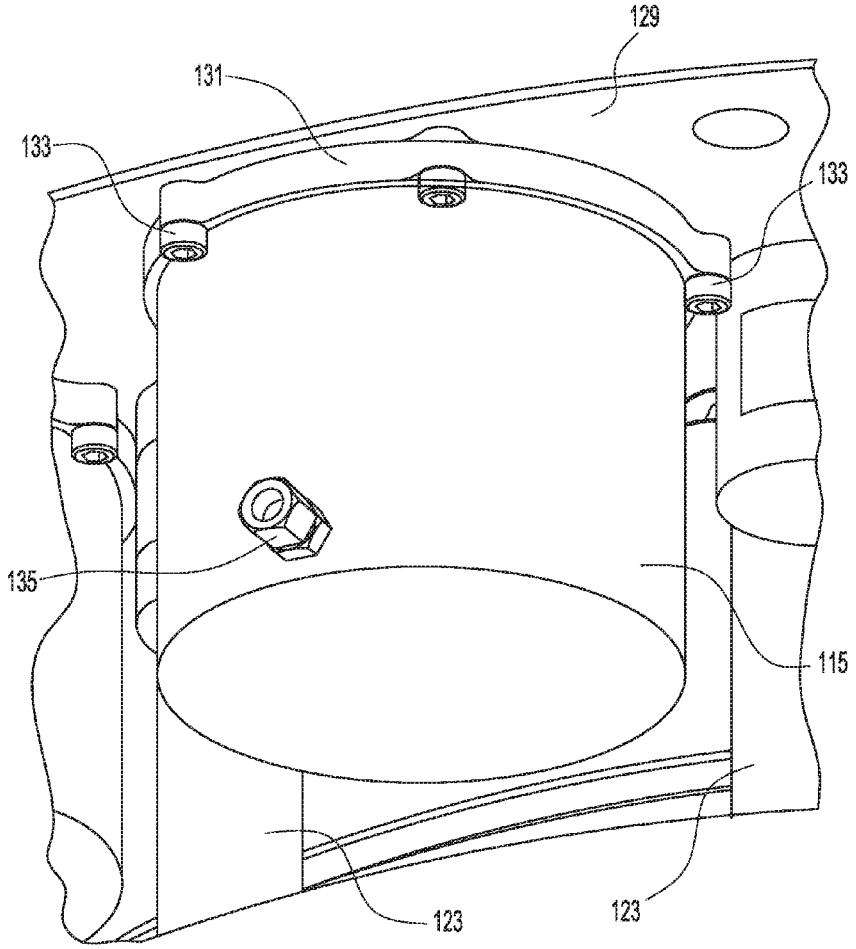
FIG. 14 is an enlarged perspective view of the cylinder shown in FIG. 12 and FIG. 13.

Also shown in FIGS. 12 to 14 are two hydraulic inlets 135, arranged to supply hydraulic pressure on either side of the piston 117.

One can also imagine a connector of the above described type, without the protecting guiding plates 111.

While terms like upper and lower are used to describe the embodiment shown in the drawings, the person skilled in the art will appreciate that the orientation of the connector 100 is irrelevant for its function. Hence such terms are not to be understood as limiting in any way.

The invention claimed is:

1. A connector system comprising:

a plurality of separate locking components distributed about a peripheral section of a connector at a connecting side of the connector, extending in a substantially axial direction, and comprising a first end, an actuation face, and an opposite locking end;

wherein the plurality of separate locking components engage with the connector at the first end and engage with a connecting part at the opposite locking end;

a guiding plate arranged between a pair of separate locking components of the plurality of separate locking components proximate the opposite locking end;

wherein the opposite locking end comprises a locking profile;

wherein the guiding plate comprises a protective face extending radially inward further than the locking profile when the locking profile is in an outwardly pivoted position;

wherein a substantially radial locking movement of the opposite locking end is provided by an axial movement of an actuation sleeve when sliding against the actuation face; and wherein the plurality of separate locking components are arranged to pivot in a substantially radial direction into and out of a locking position.

2. The connector system according to claim 1, wherein the plurality of separate locking components comprises an unlocking shoulder extending radially outwards from the first end, wherein the unlocking shoulder is adapted to be moved upwards away from the locking profiles when pivoting the plurality of separate locking components out of the locking position.

3. The connector system according to claim 2, wherein the locking profile of the plurality of separate locking components comprises one or more inclined faces that faces partially radially inwards and partially axially towards the connector;

the first end of the plurality of separate locking components comprises a first inclined adjusting face that abuts and is adapted to slide on an oppositely facing second inclined face of the connector, said second inclined face of the connector facing partially axially away from the opposite locking end of the plurality of separate locking components and partially radially outwards; and wherein the connector further comprises means adapted to move the first inclined adjusting face radially inwards on said second inclined face, thereby moving the plurality of separate locking components axially, and to retain the first inclined adjusting face in an end position.

4. The connector system according to claim 3, wherein said means comprises a pre-tension ring arranged on the connector by threads; and wherein the pre-tension ring moves axially by rotation on the connector and is adapted to move the first inclined adjusting face radially inwards by sliding engagement with an inclined sliding face of the plurality of separate locking components during said rotation.

5. An assembly comprising the connector system according to claim 3 and a calibration part, wherein:

the calibration part comprises a landing face and calibration part locking profile, which calibration part locking profile is adapted to be engaged by the locking profile of the separate locking components; and an axial distance between the landing face of the calibration part and the calibration part locking profile is a predetermined distance less than a corresponding distance of a connecting part to which the connector is adapted to connect.

6. The connector system of claim 1, further comprising a second a guiding plate arranged between a second pair of separate locking components of the plurality of separate locking components proximate the opposite locking end.

7. A method of establishing a predetermined pre-tension in locking components of a connector when the connector is landed on a landing face of a connecting part, the method comprising:

landing the connector onto the landing face of a calibration part;

moving locking profiles of the locking components a predetermined radial actuation distance into engagement with locking profiles of the calibration part;

pulling, by means of a pre-tension adjustment means, the locking components axially towards the connector until an inclined abutting face of the locking profiles of the calibration part abuts the facing abutting face of the locking profiles of the locking components, thereby limiting movement of the locking components in an axial direction towards the calibration part;

releasing the engagement to the calibration part; and landing the connector onto the landing face of the connecting part and moving the locking profiles of the locking components the predetermined radial actuation distance into engagement with the locking profile of the connecting part;

wherein said locking components being adapted to extend in a substantially axial direction from said connector towards the connecting part and to engage with a locking profile of the connecting part when the connector is landed on the landing face;

wherein the locking profile of the connecting part comprises a first inclined abutting face which faces partially radially outwards from the connecting part and partially axially away from the connector;

wherein the locking components comprises a locking profile with substantially oppositely facing abutting faces;

wherein an axial distance between said first inclined abutting face and a landing surface of the connecting part, onto which the connector is adapted to land, equals a first distance; and wherein an axial distance between a corresponding inclined abutting face and landing surface of a calibration part equals a calibration distance which is less than the first distance.

8. The method according to claim 7, wherein:

the pre-tension adjustment means is a pre-tension ring attached to the connector by means of threads; and the pulling comprises rotating the pre-tension ring, thereby moving the pre-tension ring axially in a direction of the calibration part and thereby sliding the pre-tension ring against an inclined face of the locking components and thus pulling the locking components axially towards the connector, as the locking component slides radially inwards on an inclined face of the connector.

* * * * *